United States Patent [19]

Jamar

[11] 4,403,761

[45] Sep. 13, 1983

[54] APPARATUS FOR WALL MOUNTED PRESENTATION BOARDS

[76] Inventor: Walker Jamar, 365 S. First Ave., East, Duluth, Minn. 55802

[21] Appl. No.: 222,383

[22] Filed: Jan. 6, 1981

[51] Int. Cl.[3] ..... E04G 5/06

[52] U.S. Cl. ..... 248/441 B; 248/222.2

[58] Field of Search ..... 248/222.2, 225.2, 441 B, 248/441 C, 489, 494

[56] References Cited

U.S. PATENT DOCUMENTS

| | | | |
|---|---|---|---|
| 514,222 | 2/1894 | Hall | 248/489 |
| 1,335,239 | 3/1920 | Huber | 108/134 X |
| 1,424,405 | 8/1922 | Haughton | 248/494 |
| 2,782,034 | 2/1957 | Donoghue | 248/441 B |
| 4,067,537 | 1/1978 | Pejrud | 248/489 X |
| 4,085,867 | 4/1978 | Heller | 248/222.2 X |
| 4,189,123 | 2/1980 | Johnson | 248/222.2 X |
| 4,239,170 | 12/1980 | Planebo | 248/441 B |
| 4,311,295 | 1/1982 | Jamar | 248/221.3 |
| 4,311,295 | 1/1982 | Jamar | 248/222.2 X |

FOREIGN PATENT DOCUMENTS

| | | | |
|---|---|---|---|
| 468009 | 4/1914 | France | 248/494 |
| 591229 | 9/1977 | Switzerland | 248/441 B |

*Primary Examiner*—William H. Schultz

*Attorney, Agent, or Firm*—Larson and Taylor

[57] ABSTRACT

Apparatus for wall mounting a presentation board comprises a wall mounted support bracket, a hook shaped mounting member for detachably and pivotably engaging the support bracket, and an angled support member connecting the mounting member to the presentation board such that the board is supportable in an inclined position with respect to the mounting wall. Further apparatus is provided for mounting a bound presentation pad to the board in an orientation such that the unbound ends of a pad sheet are releasably retained against unintended displacement but successive sheets may be exposed by releasing covering sheets and allowing the released sheets to hang down from the bound ends.

9 Claims, 16 Drawing Figures

APPARATUS FOR WALL MOUNTED PRESENTATION BOARDS

FIELD OF THE INVENTION

The present invention relates in general to mounting methods and apparatus, and in particular to mounting methods and apparatus for wall mounted presentation boards.

BACKGROUND OF THE INVENTION

A mainstay of sales, seminar and similar presentations is the floor or table mounted presentation easel which is used to hold pads of papers or some other form of writing surface, or to hold posters, show cards, and the like. An alternative and more elaborate presentation unit consists of a presentation cabinet permanently mounted to a wall and usually provided with a pair of doors which open to reveal a chalk board, one or two cork board surfaces, possibly a projection screen, and the like.

Such conventional presentation units suffer from a number of disadvantages which impair their usefulness. Easels are bulky and require substantial floor space for use. Wall mounted presentation cabinets have a complex construction and thus are relatively costly. Further, wall mounted presentation cabinets are not suited to the use of writing pads as the writing surface, since successive sheets of the pad cannot be readily turned back over the top of the pad as is the case with easel mounted pads. Still further, there are many environments in which a permanently mounted wall cabinet is not appropriate and space will not allow an easel.

These disadvantages are overcome by the mounting methods and apparatus of the present invention, which allow a presentation board of exceedingly simple construction to be removably mounted to a wall and writing pads to be utilized on wall mounted boards. More specifically, in accordance with the present invention, apparatus for wall mounting of a presentation board comprises a wall mounted support bracket, a mounting member for detachably engaging the support bracket, and support apparatus connecting the mounting member to the board such that the board is supportable in an inclined position with respect to the mounting wall when the mounting member is operatively engaged with the support bracket in a board supporting position. Preferably, the mounting member comprises a hook portion for pivotably engaging the support bracket, and the support apparatus comprises an angled member having first and second legs, which advantageously are pivotably connected together, to allow the angle of inclination to be varied. Preferably the support bracket and mounting member define complementary planar surfaces which are in abutting engagement when the mounting member is operatively engaged with the support bracket in a board supporting position thereof.

In accordance with another aspect of the present invention, a presentation pad is mounted in an orientation on the presentation board such that the bound end of the pad constitutes the bottom and the unbound end constitutes the top. The upper unbound ends of the pad sheets are releasably secured by a retaining member and successive sheets are exposed by pulling the unbound ends of the covering sheets from the retaining member and allowing the freed sheets to hang down from the lower bound end of the pad.

The prior patented art shows various types of easels and presentation boards and means for holding articles thereon, including paper pads. Harris, U.S. Pat. No. 547,720, and Brooksbank, 2,355,506, both disclose the general idea of a wall mounted presentation board which is supported at an inclined angle by means of a stand-off member. Brown, 41,420, Alcorn, 2,156,829, and Davis, 2,424,387, relate generally to support stands having pivoted or hinged parts to provide an inclined supporting surface. They differ in many respects from the structures and arrangements disclosed herein.

A number of prior U.S. Pat. Nos. (Reid, No. 542,809, Filler, 751,490, Gawthrop, 3,106,799, and Phillips, 3,512,744, among others) disclose clamp holders for releasably holding the top of the copy. Others show holders for receiving the bottom of the copy. See for example Clark, 202,790, Mitchell, 493,936, Clark, 1,947,757, and Col, 1,963,887. However, none of the prior art examined discloses the particular structures and arrangements of the present invention for mounting a pad of paper on a wall mounted presentation board with the bound edges of the pad lowermost and with its unbound upper edges releasably retained so that a sheet at a time may be released and permitted to hang down over the lower bound edge so as to present to view the next sheet of the pad. This concept and the means disclosed in this application for effecting it are believed to be clearly novel in view of any art known.

Other features and advantages of the present invention are stated in or apparent from the detailed description of preferred embodiments found hereinbelow.

BRIEF DESCRIPTION OF THE DRAWINGS

FIG. 16 is a partial front elevation view of the spring biased hinge depicted in FIGS. 4–6 with the board removed for clarity.

DETAILED DESCRIPTION OF PREFERRED EMBODIMENTS

Figure 1:
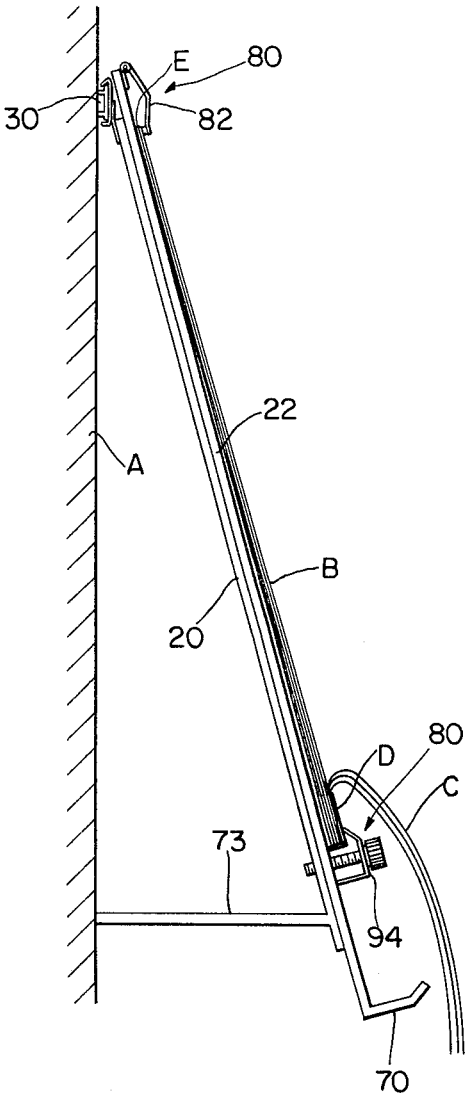
FIG. 1 is a diagrammatic side elevation view of a wall mounted presentation board constructed in accordance with the present invention.

Referring to FIG. 1, a wall mounted board 22 constructed in accordance with the present invention basically comprises a board frame 20, wall mounting apparatus 30 for mounting frame 20 to a wall and pad mounting apparatus 89 for securing a presentation pad to board 22.

Board frame 20 advantageously is of any conventional design for supporting a conventional presentation board 22. Board 22 advantageously is formed from chalkboard, or white board for use with liquid markers or as a projection screen or in fact any type of presentation surface. Board 22 advantageously also can be provided with a velcro surface for "hook and loop" mounting of three-dimensional material.

Mounting apparatus 30 preferably comprises a wall mounted support bracket 32, a mounting member 50 for detachably engaging bracket 32, and support apparatus 72 for connecting mounting member 50 to board frame 20 such that the board may be supported in either an inclined position with respect to the mounting wall or flat against the wall when mounting member 50 is operatively engaged with bracket 32 in a frame supporting position.

Any conventional bracket and cooperating mounting member advantageously constitute bracket 32 and mounting member 50. Preferably, the mounting arrangement shown in applicant's copending application, Ser. No. 086,431, now U.S. Pat. No. 4,311,295, which is hereby incorporated herein by reference, is utilized. More specifically, as is diagrammatically shown in FIGS. 2–9 of the present application, a preferred bracket embodiment generally comprises a base portion 34 for attachment to a wall A or other vertical supporting surface, and a support member 36 joined to base portion 34 so as to be disposed in spaced relationship to wall A.

Support member 36 advantageously is planar in shape, as shown, and defines upper and lower edges, denoted 26 and 28, respectively, with upper edge 26 disposed a predetermined distance above base 34 to accommodate the cooperating portion of article holder 50. Base portion 34 may be of any conventional configuration, and may be integral with or detachable from support member 36. A preferred embodiment of bracket 32 having a detachable base portion is disclosed in applicant's aforementioned co-pending application and will not be further described herein.

As is also shown in FIGS. 2–9, a preferred mounting member embodiment generally comprises a body portion, generally denoted 52, and a hook portion 54, and a leg portion 56.

Body portion 52 advantageously includes a base plate 60 having a flat or planar surface 62 which abuts the opposing outer face of support member 36 when mounting member 50 is mounted on bracket 32 in the board supporting position thereof, as shown in FIGS. 3, 4, 5, 7, and 8.

Hook portion 54 and leg portion 56 extend from body portion 52 in the same general direction and are disposed in spaced relationship with respect to each other at a distance corresponding to the distance between edges 26 and 28 of support member 36. As shown, hook portion 54 and leg portion 56 preferably are integral with base plate 60 and constitute the upper and lower edge portions, respectively, thereof.

Figure 2:
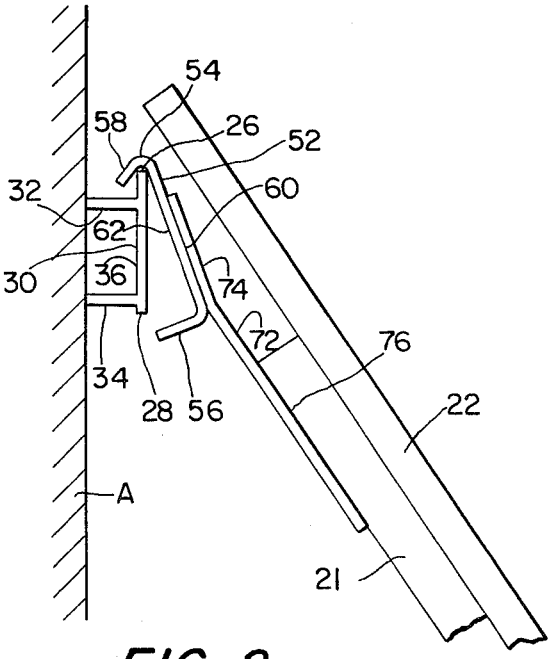
FIGS. 2 and 3 are diagrammatic side elevation views of a portion of the board shown in FIG. 1 showing a first embodiment of support apparatus constructed in accordance with the present invention.
Figure 3:
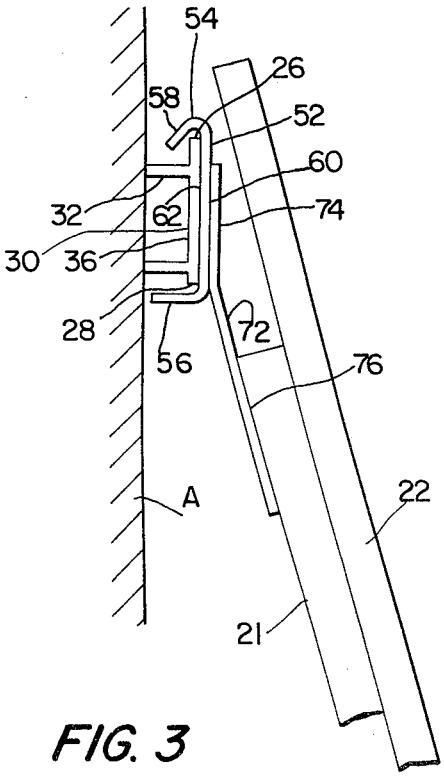

Hook portion 54 is configured for pivotably engaging upper edge 26 of support member 36 and preventing removal of mounting member 50 from bracket 30 by outward movement thereof. As shown in FIGS. 2 and 3, hook portion 54 preferably is formed by a generally straight leg member 58 joined at an acute angle to base plate 60. Advantageously, hook portion 54 allows member 50 to be pivoted from a substantially vertical supporting orientation, as shown in FIGS. 3, 4, 5, 7 and 8 wherein base plate 60 abuts support member 36, outwardly to relatively inclined orientations, as shown in FIGS. 2, 6, and 9.

Figure 6:
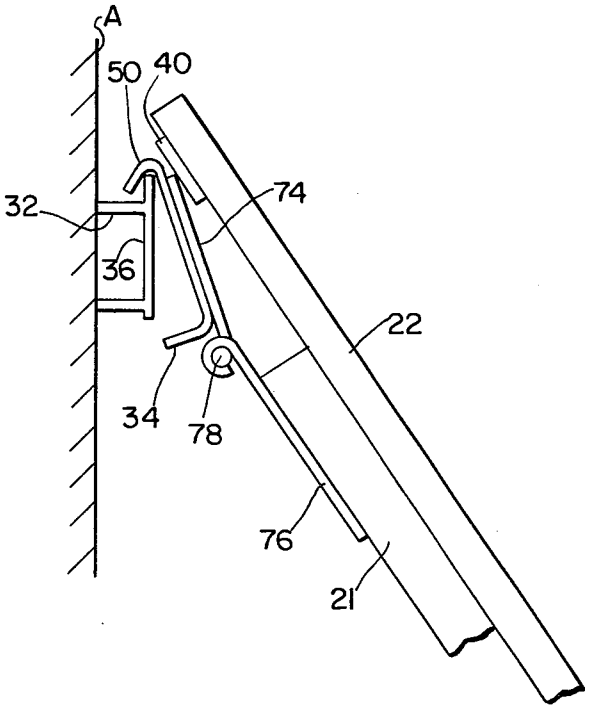
FIGS. 4–6 are diagrammatic side elevation views of a portion of the board shown in FIG. 1 showing a second embodiment of support apparatus constructed in accordance with the present invention.
Figure 9:
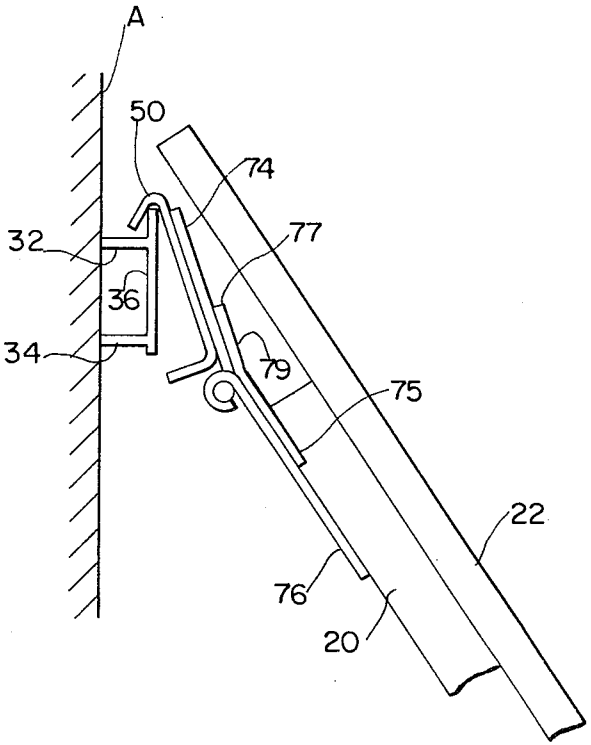
FIGS. 7, 8, and 9 are partial diagrammatic side elevation views showing a third embodiment of support apparatus.

Leg portion 56 is configured both (1) such that when hook portion 54 is operatively engaged with bracket 32 and member 50 is pivoted outwardly past a predetermined position, as shown in FIGS. 2, 6, and 9, such that body portion 52 is inclined at an angle with respect to the vertical and leg portion 56 does not overlie edge 28 of support member 36, holder 50 may be removed from bracket 32 by vertical movement thereof; and (2) such that when hook portion 54 is operatively engaged with bracket 32 and member 50 is pivoted inwardly past the predetermined position, as shown in FIGS. 3, 4, 5, 7, and 8 leg portion 56 overlies edge 28 of support member 36 and cooperates therewith to prevent vertical movement of member 50 such as would operatively disengage hook portion 54 from support member 36 and allow member 50 to be removed from bracket 36 by transverse movement thereof. As shown, leg portion 56 preferably is straight and depends from base plate 60 at a right angle thereto. Further, leg portion 56 advantageously is spaced from hook portion 54 such that leg portion 56 is adjacent to or abuts lower edge 28 of support member 36 when member 50 is mounted on bracket 30 in the substantially vertical supporting orientation shown in FIGS. 3, 4, 5, 7 and 8.

The support apparatus advantageously comprises an angled plate member 72, as shown in FIGS. 2 and 3, having first and second legs 74 and 76, respectively. As shown, leg 74 is connected to mounting member 50 such that the outer face of body portion base plate 60 and the opposing face of leg 74 are in abutting engagement and leg 76 projects outwardly, away from mounting wall A. Leg 76 is connected to the board frame 20 such that frame 20 engages the outwardly facing face of leg 76 and the weight of the board frame and presentation board urges base plate 60 of mounting member 50 against support member 36 of bracket 32. As shown, frame 20 preferably is conventionally configured so as to define a member 21 which projects from presentation board 22, and leg 76 is connected to the projecting face of frame member 21 such that presentation board 22 can extend beyond mounting member 50 without interference therefrom, as shown.

Figure 5:
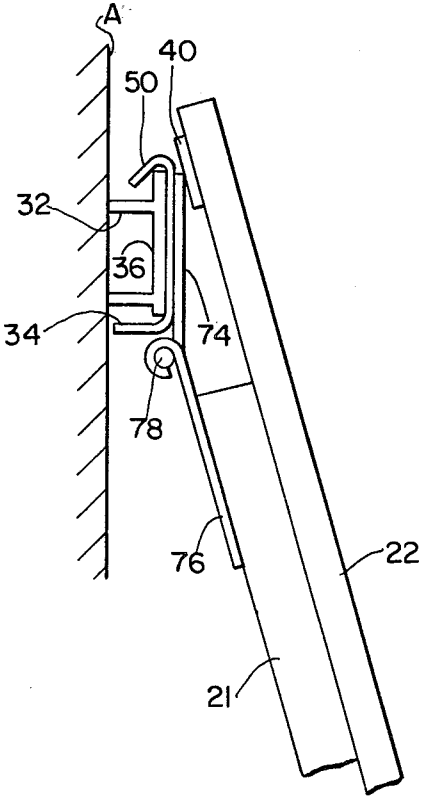
Figure 4:
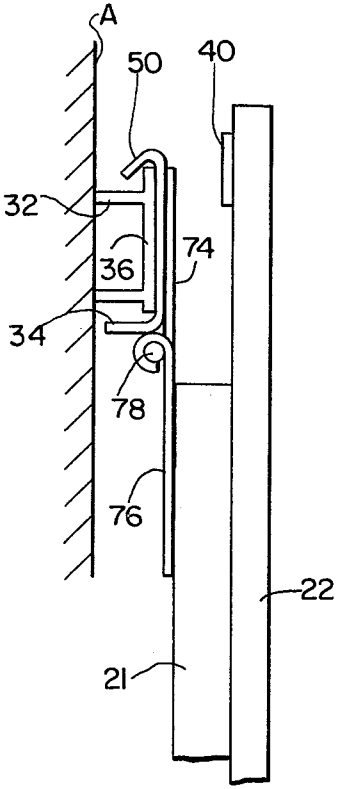

Advantageously, as shown in FIGS. 4–6, leg 74 is connected to leg 76 by a hinge 78 such that leg 76 may be pivoted with respect to leg 74 so as to vary the angle therebetween, from an angle of 180° to a predetermined minimum angle. As will be appreciated by those of ordinary skill in the art, the presentation board 22 can thus be disposed at a variable angle of inclination, including a substantially vertical inclination. Preferably, a conventional spring loaded hinge, as depicted in FIG. 16, constitutes spring hinge pivot 78 and connects legs 74 and 76 of plate member 72, the action of the spring in the hinge being such as to hold the hinged plate (that is, the leg 74) against a stop 40 secured to the back of the board 22 at the top thereof, as shown in FIGS. 4, 5, and 6. Were there no such spring, when the board was completely removed from the wall mounted support bracket 32 the hinged upper leg 74 would tend to fold completely down. Then to attach the board to the support bracket again, it would be necessary to manually return the upper leaf 74 of the hinge to an upright position.

The function of the stop 40 is to limit the extreme position of hinged upper leg 74, acting under the force of the spring, so that it is relatively convenient to unhook the board from the wall mounted molding. Were there no such stop, the spring would force the upper leaf 74 of the hinge to the back of the board and the length of the board above the hinge, and it would become inconvenient at best and impossible at worst to unhook the board from the support bracket. The weight of the board itself acts to bring the mounting member 50 into a positive and secure engagement with the support bracket 32.

Figure 8:
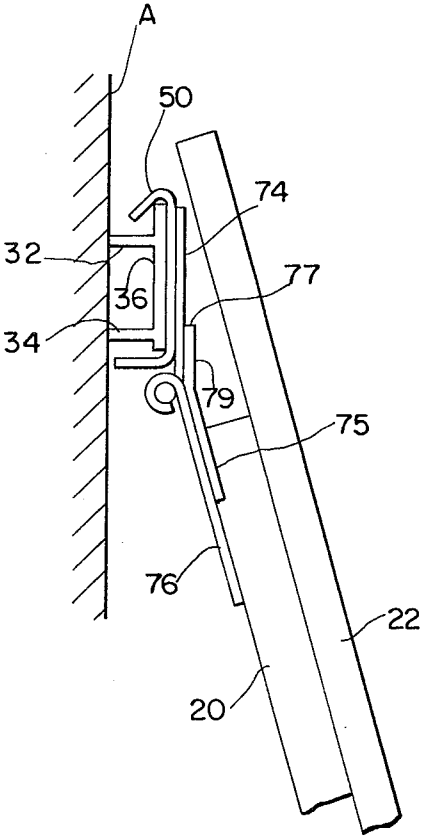
Figure 7:
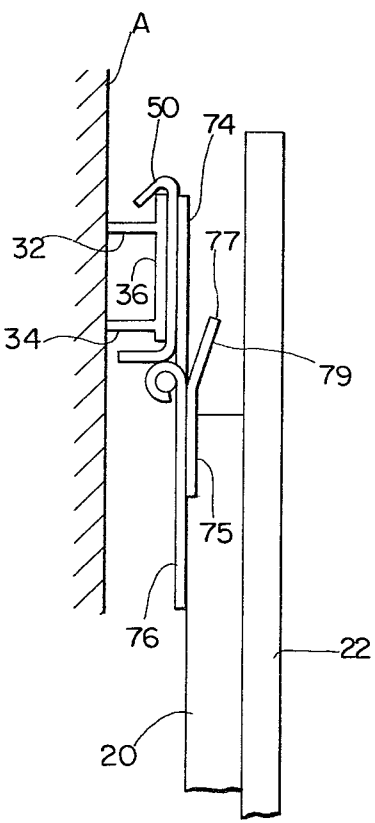

Another form of stop is shown in FIGS. 7, 8, and 9, in which the leg 76 has secured thereto a stop member 79 advantageously configured to define a base 75 which is mounted on the leg 76 and a leg 77 which projects at an angle from one end of base 75. Preferably, the angle of leg 77 with respect to base 75 is such that the hinge leg 74 abuts stop member leg 77 at a predetermined maximum presentation angle of presentation board 22.

Advantageously, the support apparatus further comprises a stand-off member 73 (see FIG. 1) mounted to the board frame 20 adjacent the bottom thereof, as shown in FIG. 1. Stand-off member 73 projects from the board frame 20 such that when the board is mounted on wall A the distal end of member 73 abuts the wall to support the presentation board in an inclined position. The member 73 may be pivotally mounted to frame 20 in a conventional manner (not shown) to allow member 73 to be selectively disposed in the projecting position thereof and in a non-projecting position which allows presentation board 22 to be disposed in a substantially vertical position parallel to wall A. The member 73 may also be configured so as to be adjustable in length and thereby allow the angle of inclination of presentation board 22 to be varied. As will be noted, the board 22 at its lower edge is provided with a ledge 70 which serves as a tray and container for markers.

Pad mounting apparatus is adapted for use with a conventional writing pad or the like, which will be referred to hereinafter generally as a presentation pad, and which has been diagrammatically shown in FIGS. 1, 10, 11, 12, 13, 14, and 15, and generally denoted B. As will be appreciated, pad B conventionally comprises a sheaf of sheets, generally denoted C, for writing or display which are bound together at one end denoted D in the figures, and free at the opposing end, denoted E in the figures, such that individual sheets may be exposed for use by displacing the unbound opposing ends of covering sheets. In accordance with the present invention, pad mounting apparatus 80 comprises a sheet retainer (see FIG. 10) in the form of a pressure plate 82 mounted to the top of presentation board for lightly securing the unbound end E of the pad B such that unintended displacement of sheets C is prevented but individual sheets can be readily released to allow exposure of underlying sheets. Pad mounting apparatus further comprises a pad holder 94 (see FIGS. 14 and 15) mounted to presentation board 22 below sheet retainer 82 for holding or securing bound end D of the pad such that pad B has an orientation on the presentation board 22 wherein effectively unbound end E constitutes the top and bound end D constitutes the bottom of pad B.

The pressure plate arrangement shown (see FIGS. 10, 11, and 12) advantageously constitutes sheet retainer 82 comprised of a generally V-shaped pressure plate 84 pivotably mounted to board 22 by a spring-loaded hinge 86. The spring biasing provided by hinge 86 is designed to facilitate release of sheets. A biasing sufficient to prevent displacement of sheets due to the weight of the sheets, static electricity, stray breezes, or the drag of the writing instrument being utilized is required. Advantageously, as shown, plate 84 is formed with a lip 88 on which is mounted an anti-slip pad 90 of rubber or plastic foam for engagement with the uppermost sheet of pad B. As will be appreciated, anti-slip pad 90 minimizes the biasing required to adequately secure the unbound end of pad B.

As will be seen from FIGS. 11, 12, 13, 14, and 15, the invention includes clamping means for securing the lower or bound edge of the pad to the board. A preferred form of such clamping means (shown in FIGS. 14 and 15) will be described in detail hereinafter. At this point, it suffices to make general reference to its existence and function.

It is a most important feature of the present invention that the presentation board be capable of supporting the paper pad with its unbound edge uppermost so that after use of one sheet, that sheet may, at its upper edge, be disengaged from the retaining means and dropped downwardly over the clamping means for the lower bound end of the pad.

A key factor in a suitable restraint for the paper on the pad is the weight of the paper itself. For the sake of illustration, consider the pad attached to a board which, in its extreme position, may be either horizontal or vertical. In the horizontal position there is absolutely no tendency for the paper to slide off the board under its own weight. In the vertical position essentially the entire weight of the paper must be supported by the restraint at the top since neither the individual sheet of paper nor the collective number of sheets in the pad has any real strength acting as a column supported from the bottom of the pad. With the board inclined at an angle from the vertical, the weight of the paper tends to be supported in part by the board and in part by the top restraint. Further, the top restraint, in effect, acts only on the top sheet of paper, all sheets below that top sheet being necessarily held by the top sheet.

Figure 12:
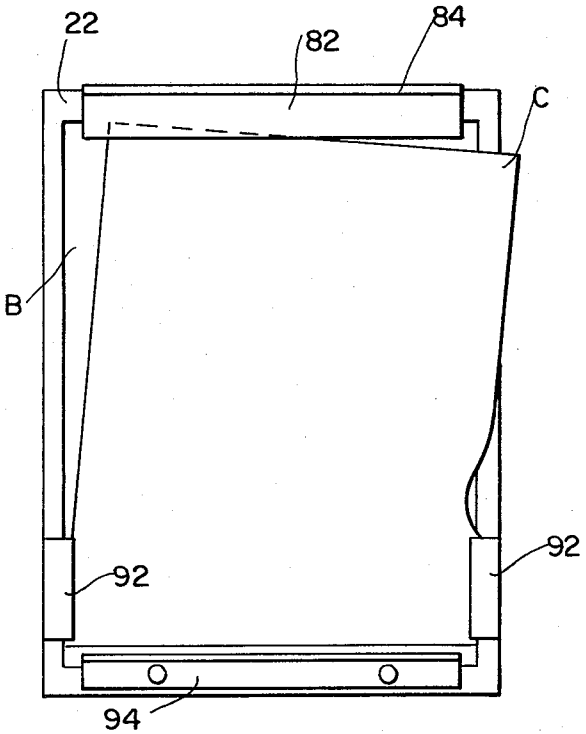
FIG. 12 is a similar view showing the use of restraining means near the lower or bound end of the pad.
Figure 11:
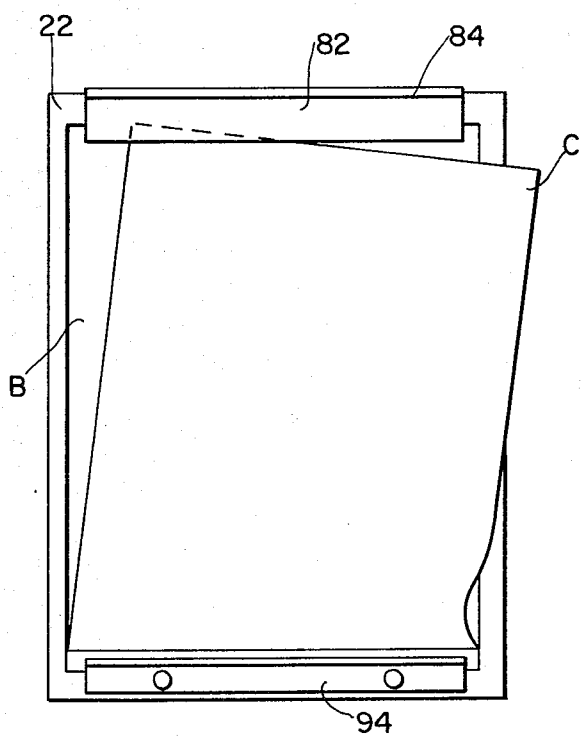
FIG. 11 is a front elevation view showing the top edge of a sheet of the pad after partial release.

Only after a great deal of thought and experimentation was the arrangement now shown arrived at which provides both a workable and practical means of holding paper pad with the free unbound edges uppermost, when, say the paper is about 24" long. It has been found (as shown in FIGS. 1, 11, and 12) that the restraint means for the sheets at the upper unbound edge of the pad should extend essentially the full width of the paper pad so that when the top sheet is released by pulling to one side and down that the restraint immediately begins to grip the second sheet (FIG. 11).

The strength of the springs in the hinge 86 for the pressure plate (FIG. 10) and the "stickiness" of the anti-slip pad 90 must be in such balance that the top sheet of the pad will be adequately held and yet not too tightly that the top sheet may not be pulled loose when the second sheet is to be exposed.

Figure 13:
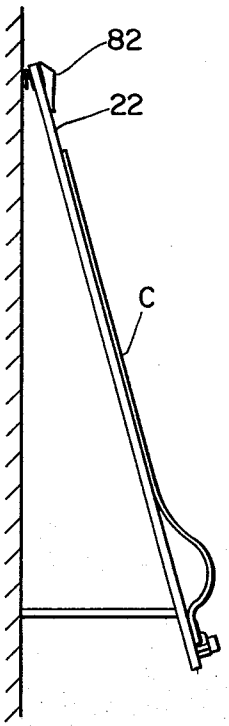
FIG. 13 is a side elevation view showing how the paper tends to pull out of the pressure pad if no restraining means are employed.

When using longer pads, it appears to be essential also to restrain the edges of the pad on the sides near the bottom (see FIG. 12) by means of the retraint means 92 to prevent the entire pad of paper from buckling under its own weight as shown in FIG. 13.

Figure 15:
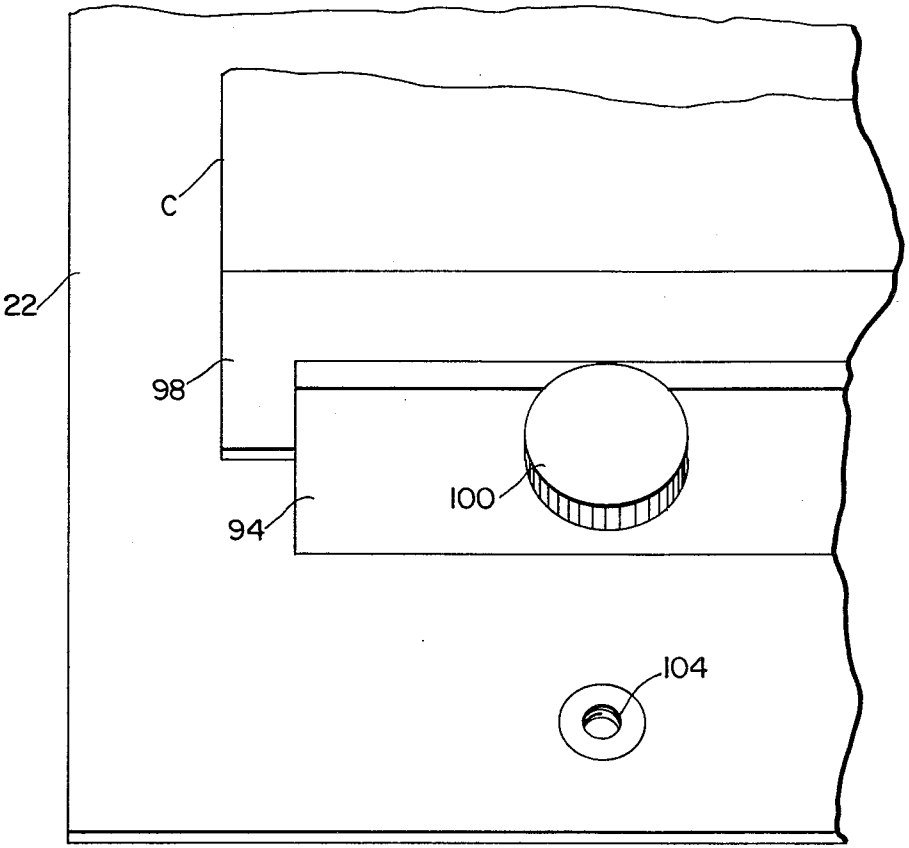
FIG. 15 is a partial front elevation view of the clamp device shown in FIG. 14.
Figure 10:
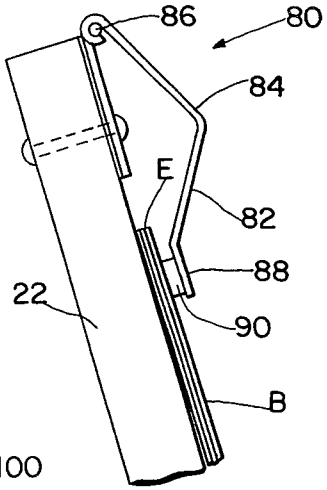
FIG. 10 is a partial diagrammatic side elevation view showing the mechanism for releasably retaining the unbound upper ends of the pad.
Figure 14:
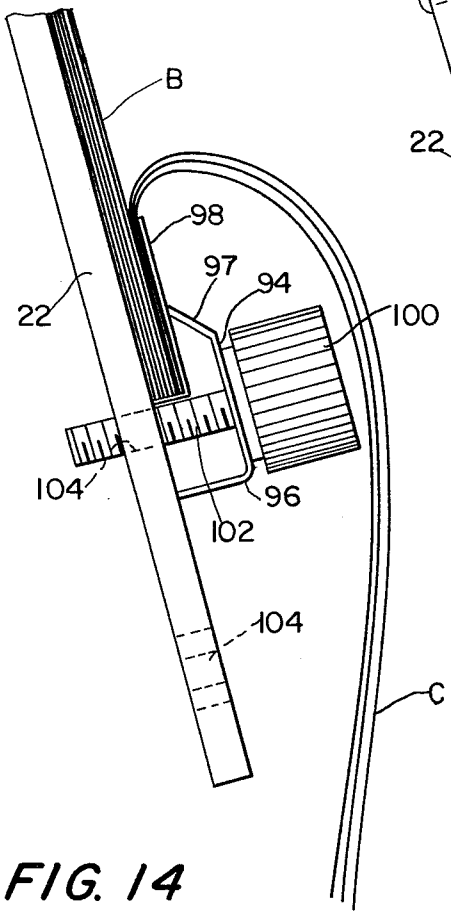
FIG. 14 is a partial side elevation showing the preferred type of clamp for clamping the bound lower ends of the pad to the board.

For securing the bottom or lower bound edge of the pad to the board, I have devised the clamping arrangement illustrated in FIGS. 14 and 15. As will be seen from those figures, an elongated clamp 94 is provided having an elongated sheet strip, one edge 96 of which is bent at right angles to form an edge which is adapted to bear against the board. The other edge of the clamp strip has an edge portion 97 bent at an angle so that its edge may engage the binding 98 of the pad when the clamp is forced in the direction of the board by turning the knob 100 on the threaded stud 102 in a thread insert 104 in the board.

It is important, in fact, necessary to maintain the distance between the clamp at the bottom of the pad and the restraining device at the top of the board more or less equal to the length of paper pad used.

The board may be provided, as shown, with at least two alternate locations of threaded inserts 104 to which the pad clamp can be mounted so as to be able to accommodate a range of paper pad sizes.

As will be appreciated by those of ordinary skill in the art, that mounting a presentation pad in an orientation on the presentation board with the bound edge lowermost in the manner described effectively secures the individual sheets for use yet allows successive sheets to be readily reached simply by pulling the used sheets loose from sheet retainer 82 and allowing them to hang down from the bottom of the presentation board, as shown.

It will also be appreciated that the wall mounted board construction of the present invention is exceedingly simple and inexpensive to manufacture. Moreover, the floor space which is required is greatly minimized. A presentation board of a size sufficient to hold a 24" pad, mounted in accordance with the present invention, the board need extend into a room a maximum of only 9" when inclined and only 1½" when vertical. Compared with the approximately 30 inches of floor space required by a typical conventional floor mounted easel, the space saving can be significant, particularly in modest sized meeting or conference rooms. With support bracket 32 extending the entire width of a wall, several presentation boards can be hung and used for multiple facets of a presentation. The presentation boards are readily removable yet securely mounted when in use. When the boards are removed for storage or use elsewhere, the remaining support bracket can be used to display other work or can be left unused without offense to the room decor.

Thus, while the invention has been described in detail with respect to exemplary embodiments thereof, it will be understood by those of ordinary skill in the art that these and other variations and modifications may be effected in the exemplary embodiments within the scope and spirit of the invention.

I claim:

1. Apparatus for wall mounting of a presentation board comprising:

a wall mounted support bracket;

mounting means for detachably engaging said support bracket; and support means connecting said mounting means to the presentation board such that the board is supportable in an inclined position with respect to the mounting wall when said mounting means is operatively engaged with said support bracket in a board supporting position, said support means including an angled member having first and second legs pivotally connected together and also respectively connected to said mounting means and to the board such that the angle between said mounting means and the board is variable and a spring means for biasing said first leg with respect to said second leg such that when the board is removed from said support bracket said first leg is held away from said second leg and in a position to permit the mounting means to be readily re-attached to said support bracket.

2. The apparatus of claim 1 wherein said mounting means includes a hook portion for pivotably engaging said support bracket such that said mounting means is pivotable from a release position to the board supporting position.

3. The apparatus of claim 2 wherein said support bracket defines a planar outer surface and said mounting means includes a body portion connected to said hook portion and defining a planar surface which abuts the outer surface of said support bracket when said mounting means is in said board supporting position.

4. The apparatus of claim 1 further comprising a standoff member connected to the board so as to project therefrom such that when the board is mounted on the wall the distal end of said stand-off member abuts the mounting wall to support the board in an inclined position.

5. The apparatus of claim 1 further comprising a hinged stand-off member connected to the board so selectively as to either project therefrom or to fold flat against the board, the stand-off being such that when projecting from the board the distal end of said stand-off abuts the mounting wall to support the board in an inclined position and when folded flat against the board permitting the board to hang vertically from the support bracket.

6. The apparatus of claim 1, and a stop member for limiting the pivoted displacement of said first leg with respect to said second leg such that further displacement of said second leg causes said mounting means to be pivoted toward said release position.

7. The apparatus of claim 1, and a stop member for limiting the pivoted displacement of said first leg with respect to said second leg such that further displacement of said second leg causes said mounting means to be pivoted toward said release position, said stop member secured to said support means.

8. The apparatus of claim 1, and a stop member for limiting the pivoted displacement of said first leg with respect to said second leg such that further displacement of said second leg causes said mounting means to be pivoted toward said release position, said stop member being mounted on the rear surface of said board near its upper edge.

9. The apparatus of claim 6 wherein said support bracket comprises a support member disposed in spaced relationship to the mounting wall and defining upper and lower surfaces and said planar outer surface; said hook portion is configured to pivotably engage a first one of said support member upper and lower surfaces and to prevent disengagement of said mounting means from said support bracket by transverse outward movement of said mounting means; said mounting means further comprising a leg portion connected to said body portion for allowing said mounting means to be disengaged from said support bracket by vertical movement thereof when said hook portion is operatively engaged with said support member and said mounting means is pivoted outwardly to a position constituting said release position where said leg portion does not overlie said support member, and for preventing vertical movement of said mounting means which would operatively disengage said mounting means from said support bracket when said hook portion is operatively engaged with said support member and said mounting means is pivoted inwardly past said release position such that said leg portion overlies said support member and cooperates with a second one of said support member upper and lower surfaces.

* * * * *